US005928089A

United States Patent [19]

Smith

[11] Patent Number: 5,928,089

[45] **Date of Patent: *Jul. 27, 1999**

[54] GOLF CLUB

[76] Inventor: George W. Smith, 11739 Turkey Creek Rd., Knoxville, Tenn. 37922

[ * ] Notice: This patent is subject to a terminal disclaimer.

[21] Appl. No.: 09/023,456

[22] Filed: Feb. 13, 1998

Related U.S. Application Data

[63] Continuation-in-part of application No. 08/308,555, Sep. 19, 1994, abandoned, and a continuation-in-part of application No. 08/667,612, Jun. 21, 1996, Pat. No. 5,570,672.

[51] Int. Cl.[6] ..... A63B 53/02

[52] U.S. Cl. ..... 473/314

[58] Field of Search ..... 473/305, 306, 473/307, 308, 309, 310, 311, 312, 313, 314, 315, 324, 289, 290

[56] References Cited

U.S. PATENT DOCUMENTS

| | | |
|---|---|---|
| 1,135,621 | 4/1915 | Roberts . |
| 1,250,296 | 12/1917 | Fitzjohn et al. . |
| 2,784,969 | 3/1957 | Bradon . |
| 2,973,581 | 3/1961 | Rhodehamel . |
| 3,077,350 | 2/1963 | Koorland . |
| 3,989,257 | 11/1976 | Barr . |
| 4,163,554 | 8/1979 | Bernhardt . |
| 5,014,992 | 5/1991 | McCalister . |
| 5,133,555 | 7/1992 | Bailey . |
| 5,224,705 | 7/1993 | Scheie . |
| 5,226,654 | 7/1993 | Solheim . |
| 5,267,733 | 12/1993 | Szokola . |
| 5,338,029 | 8/1994 | Falzone . |
| 5,720,672 | 2/1998 | Smith . |

OTHER PUBLICATIONS

Supplement To Golf Digest—Rules of Golf for 1992—United States Golf Association.

*Primary Examiner*—Sebastiano Passaniti
*Attorney, Agent, or Firm*—Pitts & Brittian, P.C.

[57] ABSTRACT

An improved golf club having a curved or angled hosel is provided. In the preferred embodiment of the present invention the hosel has an upper end axially aligned with and securely attached to the lower end of the elongated shaft, a lower end attached to the top of the clubhead approximately 0.625" inset from the heel. The preferred hosel also has a curved middle member configured such that the leading edge of the sole is substantially aligned with the forwardly facing surface of the shaft.

6 Claims, 7 Drawing Sheets

GOLF CLUB

This application is a continuation in part of Ser. No. 8/308,555 filed Sep. 19, 1994, abandoned, and a continuation in part of Ser. No. 8/667,612 filed Jun. 21, 1996, now U.S. Pat. No. 5,570,672, issued Feb. 24, 1998.

TECHNICAL FIELD

This invention relates to the field of golf. More particularly, the present invention relates to a golf club, such as a driver or fairway wood, having an improved hosel.

BACKGROUND ART

Since the creation of the game of golf, there have been numerous improvements to the golf club. These inventions have focused on the various components of the golf club, such as the hosel or socket, which joins the shaft with the clubhead. In order to overcome the natural tendency of the head of the golf club to torque in reference to the longitudinal axis of the shaft on impact with a golf ball, much attention has been focused on the configuration of the hosel.

For instance, U.S. Pat. No. 1,250,296, issued to Stanton on Dec. 18, 1917, discloses a golf club having a curved shank that is integral with the head, with the junction of the loop and the head being substantially midway between the opposite ends of the lower edge of the head mainly below the longitudinal center of the head. The golf club taught by Stanton has the leading edge of the sole substantially forward of the forwardly facing surface of the shaft. However, it can be advantageous to have a club whose leading edge of the sole is in substantial alignment with the forwardly facing edge of the shaft.

U.S. Pat. No. 3,077,350, issued to Koorland on May 7, 1959, discloses a golf putter having a shaft that is configured so as to locate the hands of a golfer directly over the center of the golf ball when the forward face of the head is in contacting relationship with the ball. Thus, the forwardly facing surface of the shaft is located well forward of the leading edge of the sole.

U.S. Pat. No. 3,989,257, issued to Barr on Nov. 2, 1976, discloses a golf putter having a specially configured head. While the figures show a curved neck, the leading edge of the sole is well forward of the shaft and is not substantially aligned with the forwardly facing surface of the shaft.

U.S. Pat. No. 4,163,554, issued to Bernhardt on Aug. 7, 1979, also discloses a golf putter. Bernhardt's putter has an elongated shaft having upper and lower grip portions for putting "croquet style". It is noted that Bernhardt teaches a curved connecting neck portion at Col. 7. Bernhardt teaches that it is advantageous for the neck to be configured such that the longitudinal axis of the shaft will intersect the top surface of the clubhead at a point between the ball-striking surface and the rear surface and between the vertical axis and the outermost end of the clubhead. While this may be an advantageous configuration for a putter, those skilled in the art will recognize that if the neck of "short irons", i.e. the 7–9 irons and the various wedges, is configured in this manner, the leading edge of the sole will be positioned substantially forward of the forwardly facing surface of the shaft.

U.S. Pat. No. 1,135,621, issued to D. and K. Roberts on Apr. 13, 1915, teaches a golf club having a series of interchangeable heads so made and arranged that they can be attached to the shaft in either of two positions so that each head provides the equivalent of two clubs. In order to accomplish this, Roberts utilizes an extension which is provided upon a curved socket. Roberts teaches that the extension of the socket is angled to conform to the average angle of the striking faces of the several clubs. This extension is received in a dovetail groove on the rear face of the head formed by means of upper and lower lugs separated by a space. Per Roberts teachings, the front face of each head is not parallel with the rear face of the head, "so that by reversing the said heads relative to the extension c of the socket b the equivalent of two clubs can be obtained." Thus, a single shaft and socket can be combined with multiple interchangeable heads to provide different loft angles for the several irons. Roberts lacks a hosel that is adapted so as to maintain a coplanar relationship between the curved, or angled, portions of the middle member of the hosel and the longitudinal axis of the elongated shaft while simultaneously maintaining substantial alignment between the leading edge of the sole and the forwardly facing surface of the shaft, regardless of the loft angle of the head.

Other patents that the inventor is aware of are U.S. Pat. No. 2,784,969, issued to Brandon on Mar. 12, 1957; U.S. Pat. No. 2,973,581, issued to Rhodehamel on Mar. 7, 1961; U.S. Pat. No. 5,014,992, issued to McCallister on May 14, 1991; U.S. Pat. No. 5,133,555, issued to Bailey on Jul. 28, 1992; U.S. Pat. No. 5,224,705, issued to Scheie on Jul. 6, 1993; U.S. Pat. No. 5,226,654, issued to Karsten Solheim on Jul. 13, 1993; U.S. Pat. No. 5,267,733, issued to Szokola on Dec. 7, 1993; and U.S. Pat. No. 5,338,029, issued to Falzone on Aug. 16, 1994.

What is missing from the art is a hosel, having a compound curve disposed in the same plane as the longitudinal axis of the shaft and that is uniquely adapted such that, with the irons, it has its junction with the clubhead at the back approximately 0.625" inset from the heel, in the preferred embodiment, and midway between the top edge of the head and the sole and is configured such that, regardless of the pitch of the particular iron or wedge, the leading edge of the sole is substantially aligned with the forwardly facing surface of the shaft; and that, when utilized with a wood, such as a driver or a fairway wood, has its junction with the clubhead at the top of the clubhead and inset approximately 0.625" from the heel and that is configured such that, regardless of the pitch of the particular wood, the leading edge of the sole is substantially aligned with the forwardly facing surface of the shaft. My co-pending application, Ser. No. 08/667,612 filed Jun. 21, 1996, upon which a Notice of Allowance has been received, and which will issue as U.S. Pat. No. 5,720,672 on Feb. 24, 1998, addresses the deficiency in the art with respect to irons. One of the objects of the present invention is to address this deficiency with respect to woods, such as a driver or a fairway wood.

Accordingly, it is an object of the present invention to provide an improved golf club having a specifically configured and curved hosel that is configured such that the hosel has a compound curve disposed in the same plane as the longitudinal axis of the shaft and that is uniquely adapted such that, regardless of the pitch of the particular wood, the leading edge of the sole is aligned with the forwardly facing surface of the shaft.

It is another object of this invention to provide an improved golf club, specifically, an improved wood such as a driver or a fairway wood, that includes a hosel having its junction with the clubhead at the top approximately 0.625" inset from the heel.

Other objects and advantages over the prior art will become apparent to those skilled in the art upon reading the detailed description together with the drawings as described as follows.

DISCLOSURE OF THE INVENTION

In accordance with the various features of this invention, an improved golf club, specifically a wood, such as a driver or a fairway wood, having a curved or angled hosel is provided. Those skilled in the art will understand that in the realm of woods, certain manufacturers include a traditional hosel for connecting the shaft to the clubhead of the wood, and other manufacturers simply join the lower end of the shaft directly to the clubhead of the wood. For purposes of this application, the term "hosel" is intended to cover both the traditional hosel and to cover that portion of the lower end of the shaft that engages the clubhead. In the preferred embodiment of the present invention, the hosel has an upper end axially aligned with and securely attached to the lower end of the elongated shaft, and a lower end attached to the top of the clubhead inset approximately 0.625" from the heel. The preferred hosel also has a curved middle member configured such that the leading edge of the sole is substantially aligned with the forwardly facing surface of the shaft regardless of the particular wood's loft angle. In this regard, those skilled in the art will appreciate that typical drivers can range in loft from 7.5° to about 12° and that fairway woods, including 3, 5, 7, and 9 woods have incrementally increasing amounts of loft. The curved middle member has a compound curve that wholly lies in a plane that intersects the longitudinal axis of the elongated shaft and that is perpendicular to the plane defined by the face of the clubhead. In other words, the elongated shaft, including the hosel and/or the lower end of the shaft and the curved portions all lie in a single plane.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
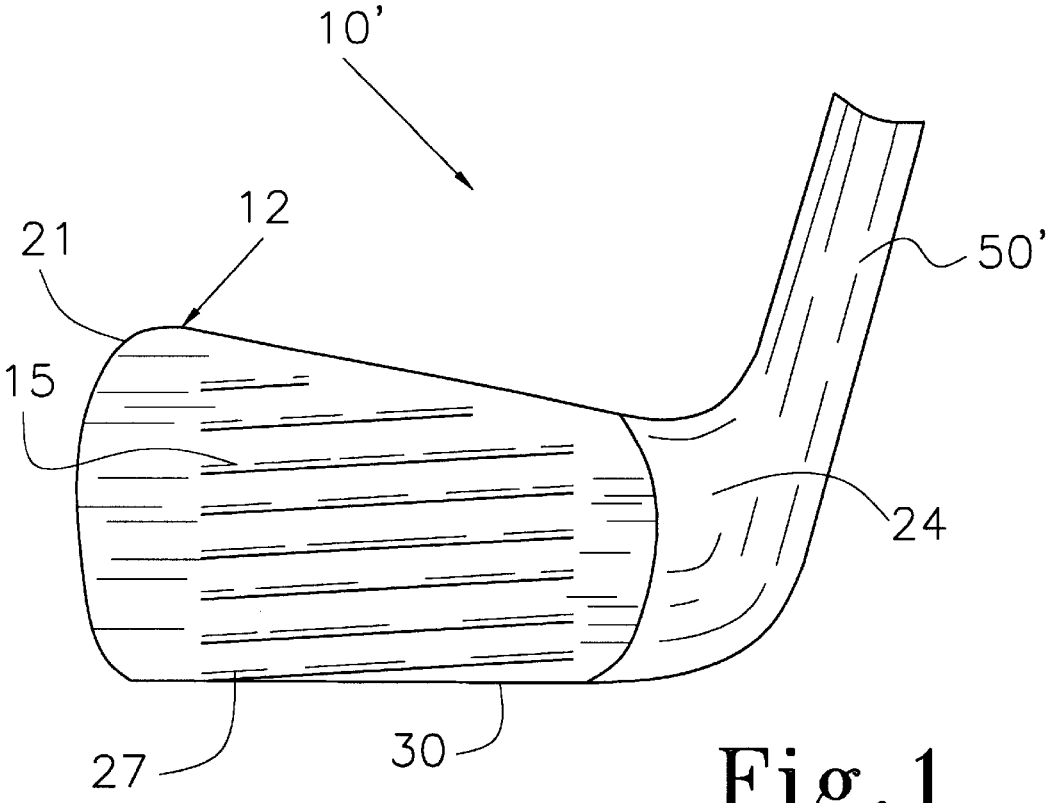
Fig. 1 (PRIOR ART)
FIG. 1 illustrates a front elevation view of a golf clubhead, i.e. an iron, having a prior art hosel.
Figure 2:
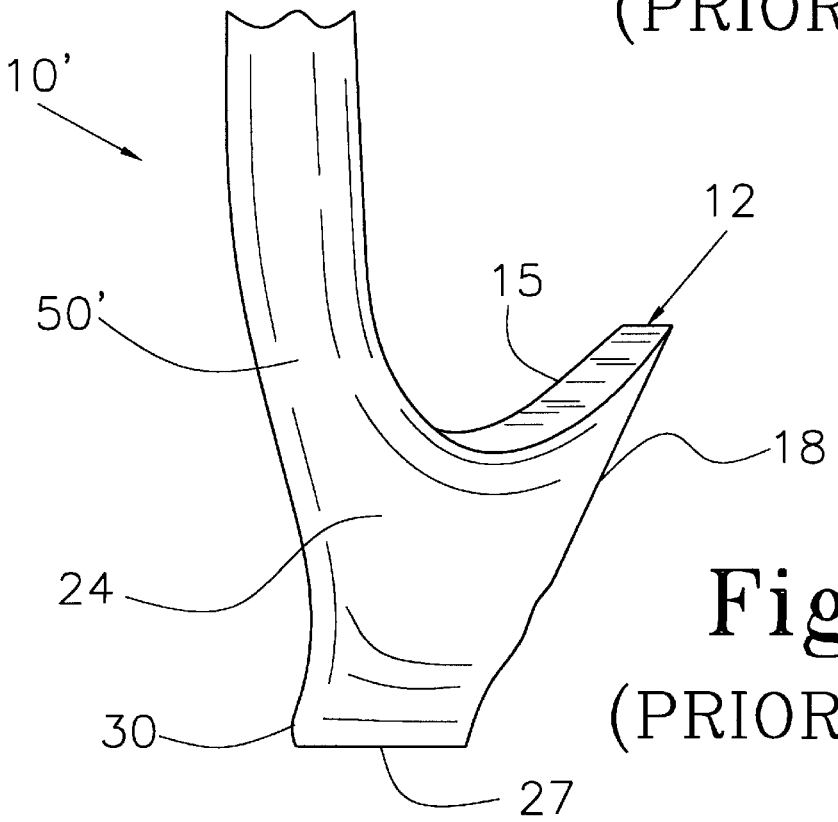
Fig. 2 (PRIOR ART)
FIG. 2 illustrates a side elevation view of a golf clubhead, i.e. an iron, having a prior art hosel.
Figure 3:
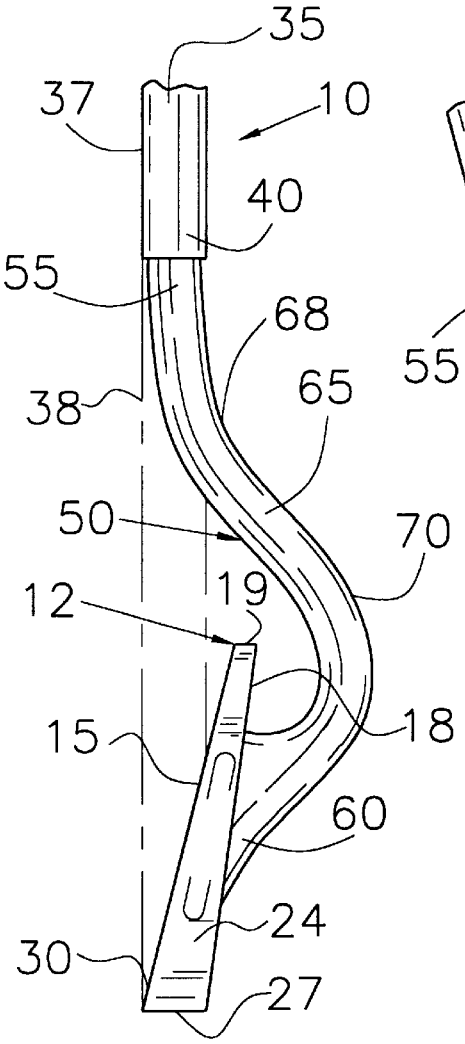
FIG. 3 illustrates a side elevation view of a long iron clubhead and hosel of the present invention.
Figure 4:
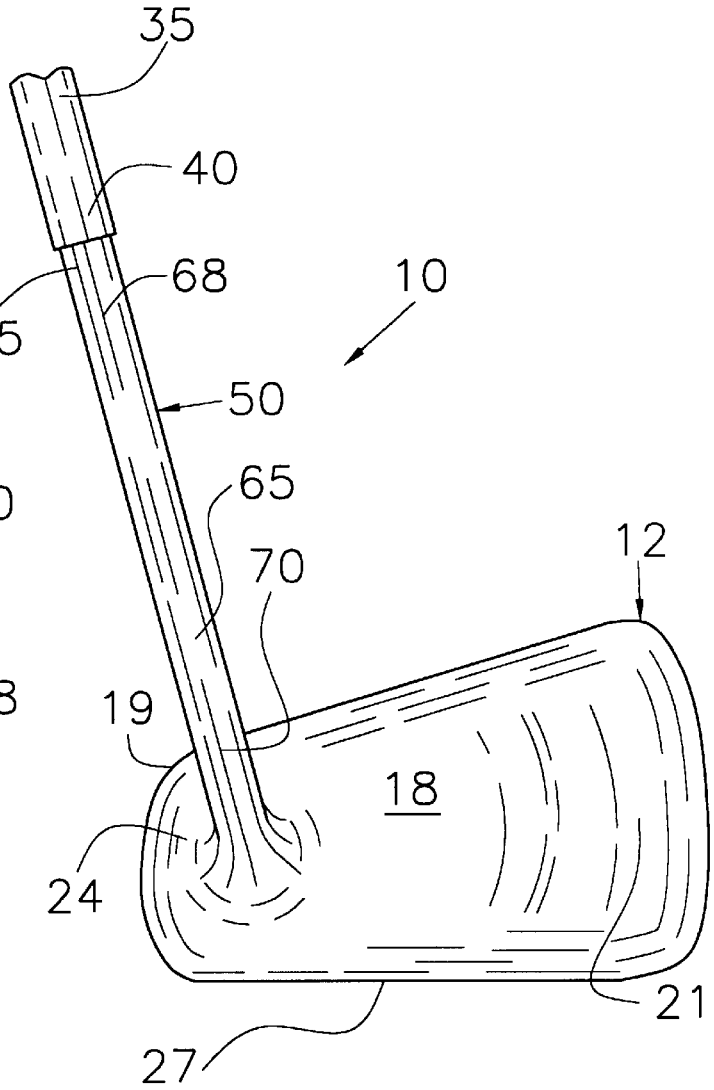
FIG. 4 illustrates a rear elevation view of a long iron clubhead and hosel of the present invention.
Figure 5:
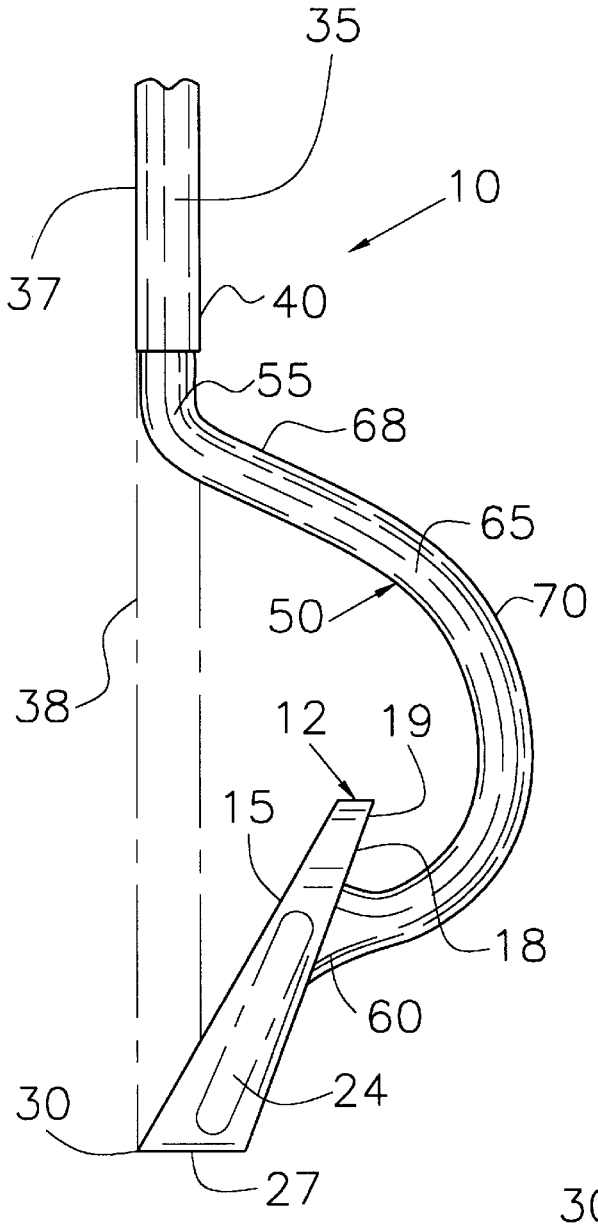
FIG. 5 illustrates a side elevation view of an intermediate iron clubhead and hosel of the present invention.
Figure 6:
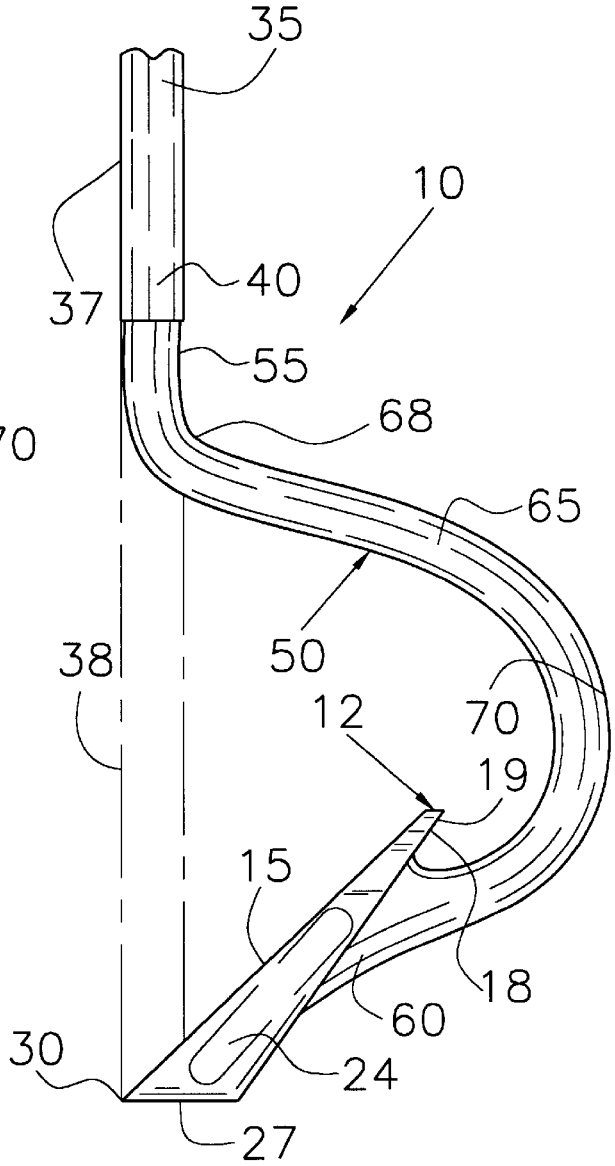
FIG. 6 illustrates a side elevation view of a short iron or wedge clubhead and hosel of the present invention.

My co-pending application, which is incorporated herein by reference described my invention as pertaining to an iron. An improved golf club of the iron variety, constructed in accordance with the teachings of the present invention, is illustrated generally as 10 in the figures. Those skilled in the art understand and appreciate that, with the exception of putters and chippers, there are two main types of golf clubs, irons, typically one through nine including wedges; and woods, which include the driver and fairway woods. FIGS. 1 and 2 illustrate a conventional iron 10' constructed in accordance with the prior art. It will be understood by those skilled in the art that an iron 10 has a clubhead 12 having a face 15, a back 18, a toe 21, a heel 24, and a sole 27, with the sole having a leading edge 30 proximate face 15. Further, iron 10 has an elongated shaft 35 having a longitudinal axis, (not shown), and a lower end 40, and a hosel 50, (50' in FIGS. 1 and 2), connected to clubhead 12 and lower end 40 of elongated shaft 35. In the preferred embodiment of the present invention, hosel 50 has an upper end 55 axially aligned with and securely attached to lower end 40 of elongated shaft 35, a lower end 60 attached to back 18 approximately 0.625" from heel 24, in the preferred embodiment, and substantially midway between sole 27 and upper edge 19 of back 18. The preferred hosel also has a curved middle member 65 configured such that leading edge 30 of sole 27 is substantially aligned with forwardly facing surface 37 of elongated shaft 35 as seen at line 38. As seen in FIG. 3, middle member 65 has first and second curved portions 68 and 70, respectively. As seen in FIG. 4, first curved portion 68 and second curved portion 70 are each disposed in a single plane, (not shown), which intersects the longitudinal axis of elongated shaft 35. Thus, as can be seen in FIG. 4, first curved portion 68 and second curved portion 70 are coplanar.

While the compound curve in middle member 65 is coplanar with the longitudinal axis of elongated shaft 35, the plane that the compound curve lies in is perpendicular to the plane that face 15 of clubhead 12 lies in. The coplanar relationship between hosel 50 and the longitudinal axis of elongated shaft 35 and the perpendicular relationship between the plane of curved middle member 65 and the plane of face 15 act together to provide a sight line, when a user is addressing the ball, making it easier to line up clubhead 12 with the ball and target when preparing to make the golf shot.

Figure 7:
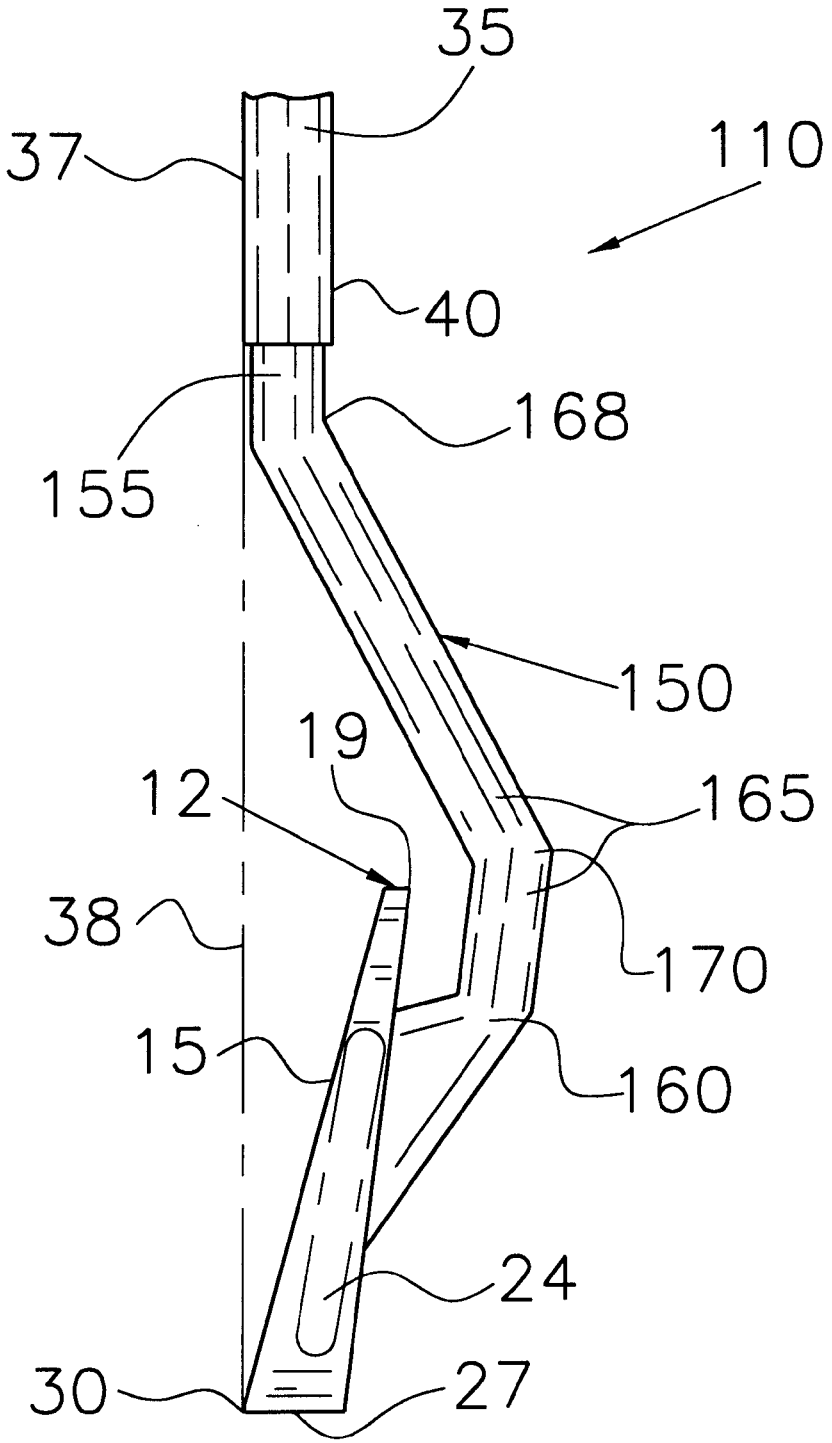
FIG. 7 illustrates a side elevation view of an alternate embodiment hosel illustrated on a long iron.

Further, in the preferred embodiment of iron 10, curved middle member 65 is further configured such that lower end 60 of hosel 50 is attached to back 18 substantially midway between upper edge 19 of back 18 and sole 27, as can be seen in FIG. 4. Most preferably, lower end 60 of hosel 50 is positioned on back 18 a distance from heel 24 of 0.625 inches in the preferred embodiment. Placement of lower end 60 of hosel 50 a distance from heel 24 of 0.625 inches results in several advantages over a prior art club such as is illustrated in FIGS. 1 and 2. Namely, there is less torquing of clubhead 12 during the down stroke; and, less torquing of clubhead 12 upon impact with the ball. These two factors combine to minimize the risk of slicing the ball. Further, due to this placement of hosel 50, i.e. 0.625 inches inside the heel, the overall effective width of clubhead 12 and hosel 50 is shorter than in prior art clubs. This reduces the amount of force needed to propel clubhead 12 through the resistance encountered in high grasses and deep rough. Also, when striking the ball in medium to deep rough, there is less grass-effect torquing of clubhead 12. As discussed in my earlier application, Ser. No. 08/667,612 filed Jun. 21, 1996, which is incorporated by reference herein, hosel 50 can be curved or faceted as seen in FIG. 7.

Figure 8:
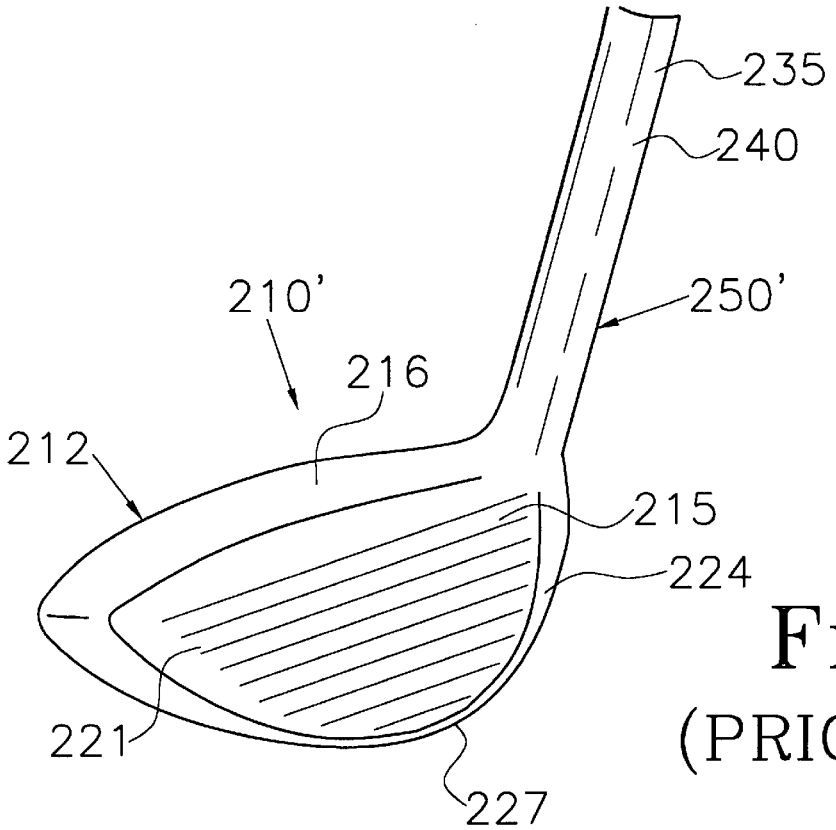
Fig.8 (PRIOR ART)
FIG. 8 illustrates a front elevation view of a golf clubhead, i.e. a wood, having a prior art hosel.
Figure 9:
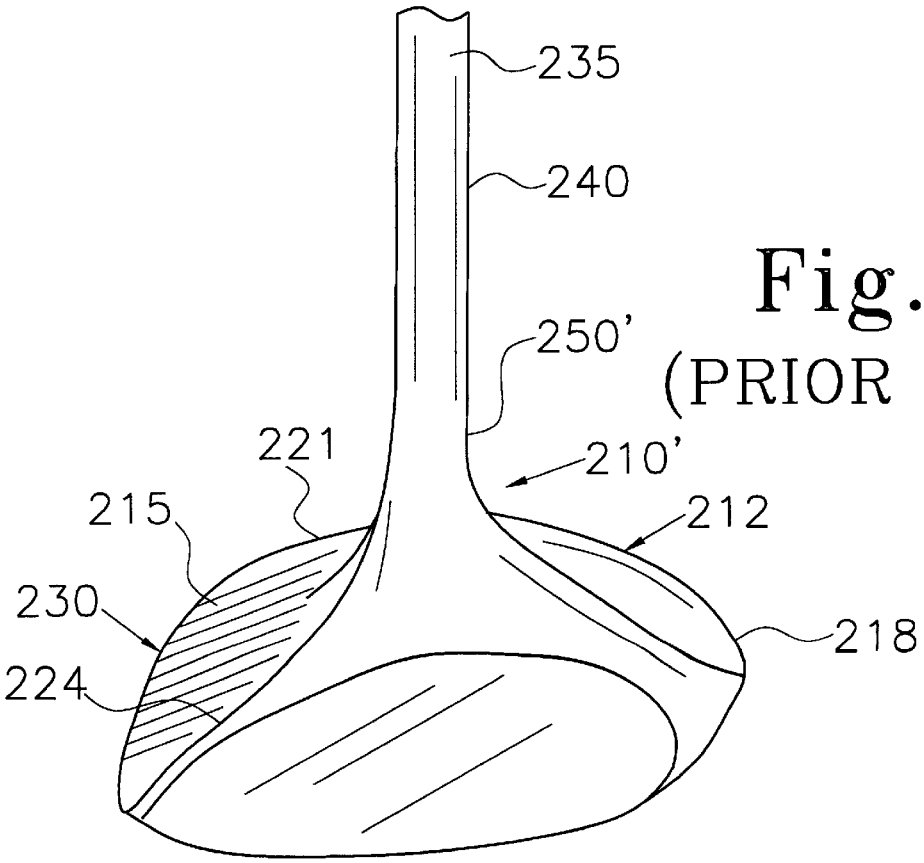
Fig.9 (PRIOR ART)
FIG. 9 illustrates a side elevation view of a golf clubhead, i.e. a wood, having a prior art hosel.
Figure 10:
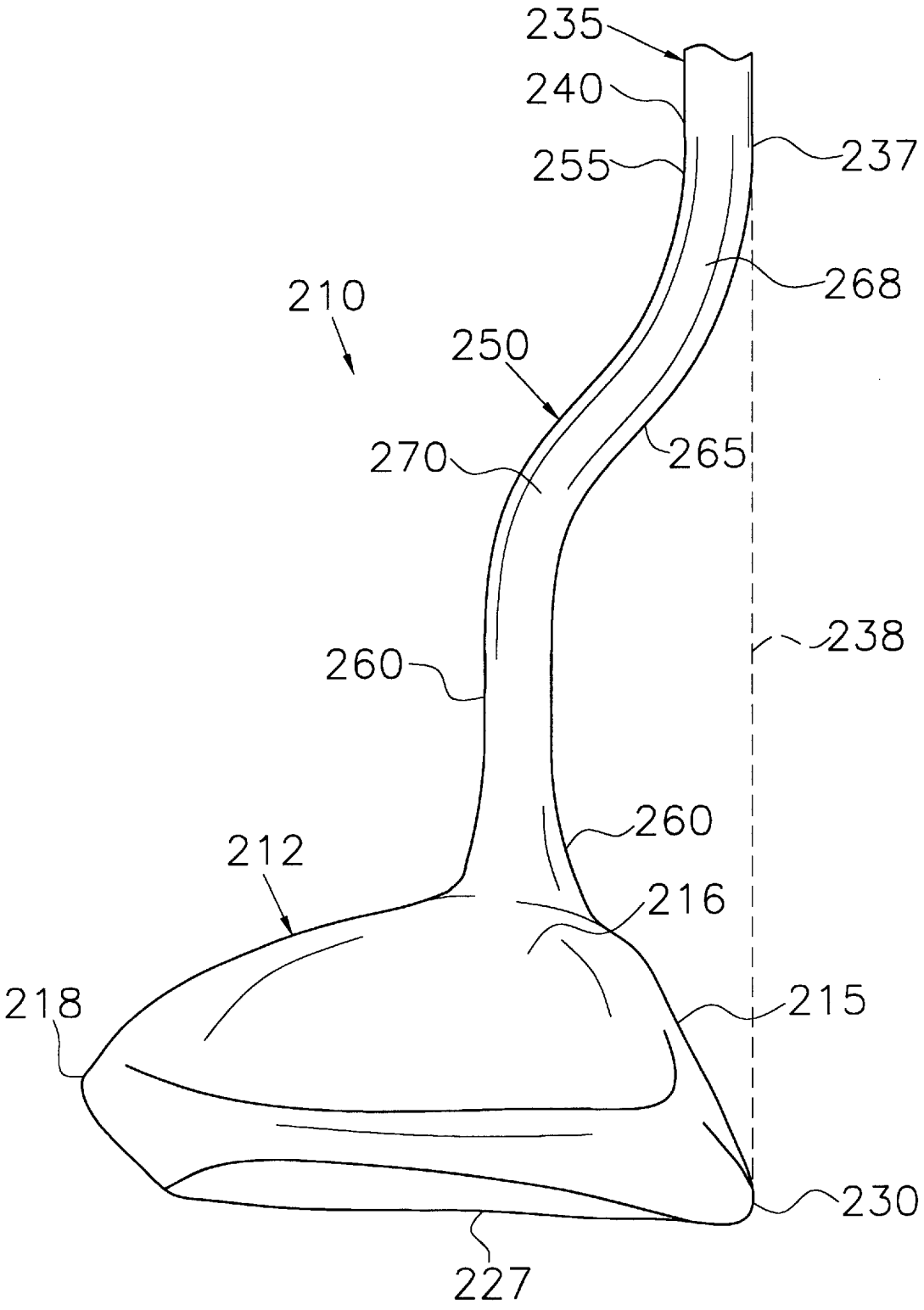
FIG. 10 illustrates a side elevation view of a fairway wood clubhead and hosel of the present invention.
Figure 11:
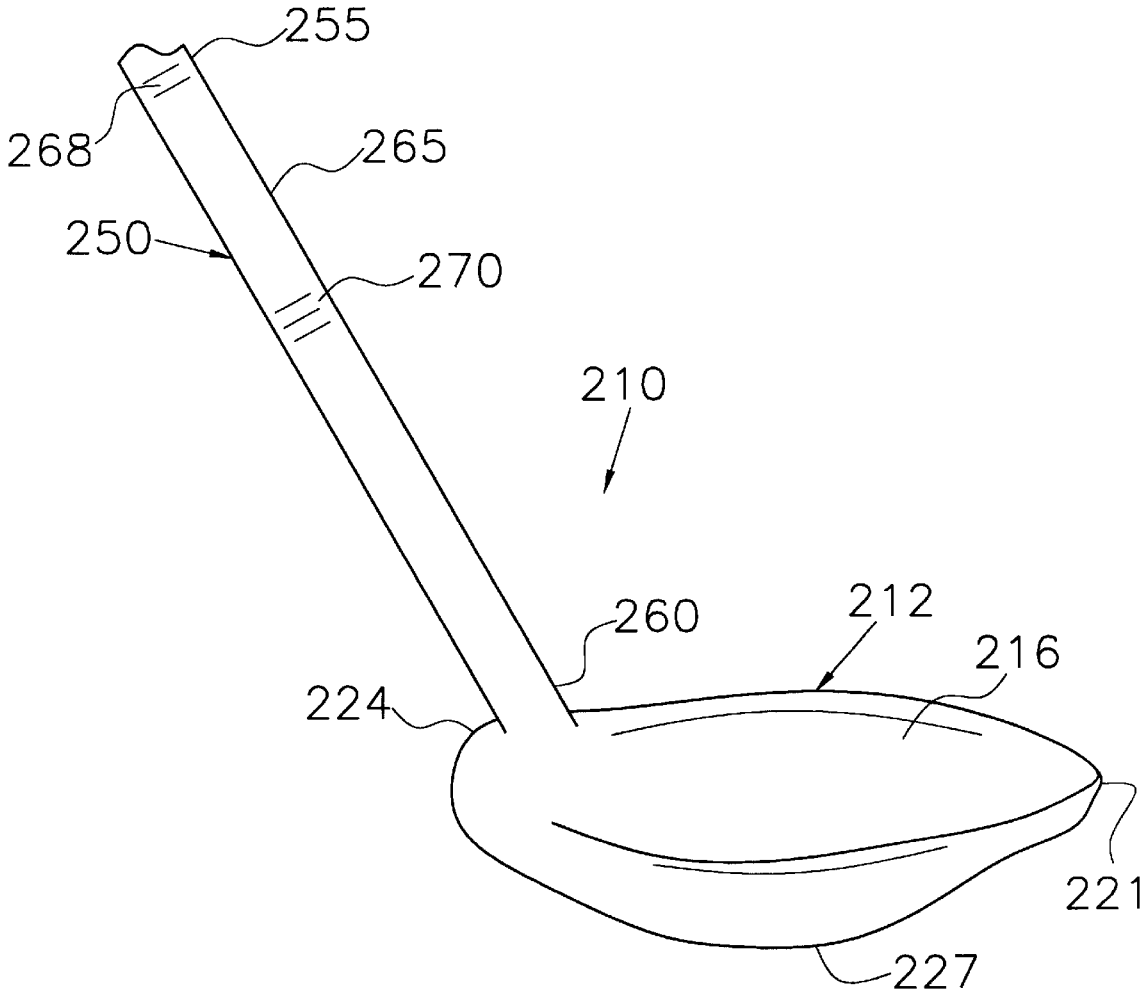
FIG. 11 illustrates a rear elevation view of a fairway wood clubhead and hosel of the present invention.

Referring now to FIGS. 8–11, the utilization of the present invention with a wood, such as a driver or fairway wood will be described. FIGS. 8 and 9 illustrate a conventional wood 210' constructed in accordance with the prior art. It will be understood by those skilled in the art that wood 210 has a clubhead 212 having a face 215, a top 216 a back 218, a toe 221, a heel 224, and a sole 227, with the sole having a leading edge 230 proximate face 215. Further, wood 210 has an elongated shaft 235 having a longitudinal axis, (not shown), and a lower end 240, and a hosel 250, (250' in FIGS. 8 and 9), connected to clubhead 212 and lower end 240 of elongated shaft 235. Those skilled in the art will appreciate that while certain club manufacturers utilize a separate hosel between the clubhead and the lower end of the shaft, other manufacturers simply affix the clubhead directly to the lower end of the shaft. As used in this disclosure and the appended claims, "hosel" is defined as that portion that engages the clubhead and is used broadly enough herein to include the lower portion of the shaft in clubs in which the lower end of the shaft directly engages the clubhead. In the preferred embodiment of the present invention, hosel 250 has an upper end 255 axially aligned with and securely attached to lower end 240 of elongated shaft 235, a lower end 260 attached to top 212 inset approximately 0.625" from heel 224, in the preferred embodiment. The preferred hosel also has a curved middle member 265 configured such that leading edge 230 of sole 227 is substantially aligned with forwardly facing surface 237 of elongated shaft 235 as seen at line 238. As seen in FIG. 10, middle member 265 has first and second curved portions 268 and 270, respectively. As seen in FIG. 11, first curved portion 268 and second curved portion 270 are each disposed in a single plane, (not shown), which intersects the longitudinal axis of elongated shaft 235. Thus, as can be seen in FIG. 11, first curved portion 268 and second curved portion 270 are coplanar and lie in a single plane with elongated shaft 235.

While the compound curve in middle member 265 is coplanar with the longitudinal axis of elongated shaft 235, the plane that the compound curve lies in is perpendicular to the plane that face 215 of clubhead 212 lies in. The coplanar relationship between hosel 250 and the longitudinal axis of elongated shaft 235 and the perpendicular relationship between the plane of curved middle member 265 and the plane of face 215 act together to provide a sight line, when a user is addressing the ball, making it easier to line up clubhead 212 with the ball and target when preparing to make the golf shot.

Further, in the preferred embodiment of wood 210, curved middle member 265 is further configured such that lower end 260 of hosel 250 is attached to top 216 inset a distance from heel 224 of 0.625 inches in the preferred embodiment. Placement of lower end 260 of hosel 250 a distance from heel 224 of 0.625 inches results in several advantages over a prior art club such as is illustrated in FIGS. 8 and 9. Namely, there is less torquing of club head 212 during the down stroke; and, less torquing of club head 212 upon impact with the ball. These two factors combine to minimize the risk of slicing the ball. Further, due to this placement of hosel 250, i.e. inset 0.625 inches inside the heel, the overall effective width of club head 212 and hosel 250 is shorter than in prior art clubs. This reduces the amount of force needed to propel club head 212 through the resistance encountered in high grasses and deep rough. Also, when striking the ball in medium to deep rough, there is less grass-effect torquing of club head 212. As discussed in my earlier application, Ser. No. 08/667,612 filed Jun. 21, 1996, which is incorporated by reference herein, hosel 250 can be curved or faceted as seen in FIG. 7.

From the foregoing description, it will be recognized by those skilled in the art that an improved golf club offering advantages over the prior art has been provided. Specifically, the improved golf club of the present invention provides an improved golf club having a hosel that has its junction with the clubhead at the top approximately 0.625" inset from the heal. The improved golf club of the present invention further provides a hosel having a compound curve that is coplanar with the elongated shaft and which lies in a plane perpendicular to the face of the clubhead and that is configured such that, regardless of the pitch of the particular wood, the leading edge of the sole is substantially aligned with the forwardly facing surface of the shaft.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, 1 claim:

1. An improved golf club comprising:

an elongated shaft having a longitudinal axis, a forwardly facing surface and a lower end; and a clubhead having a face, a top, a back, a toe, a heel, and a sole, said sole having a leading edge proximate said face; and a hosel for connecting said clubhead to said lower end of said elongated shaft, said hosel having an upper end, a lower end and a curved middle member, said elongated shaft, said upper end, said hosel lower end and said curved middle member lying in a selected plane, said upper end being attached to and axially aligned with said lower end of said elongated shaft, said lower end attached to said clubhead, said curved middle member of said hosel defining a compound curve having a first curved portion disposed entirely in said selected plane, said curved middle member having a second curved portion disposed entirely in said selected plane, wherein said first and second curved portions are adapted to allow said leading edge of said sole to be aligned with said forwardly facing surface of said shaft.

2. The improved golf club of claim I wherein said lower end of said hosel is attached to said top of said clubhead proximate said heel.

3. The improved golf club of claim 2 wherein said lower end of said hosel is attached to said top approximately 0.625 inches from said heel.

4. The improved golf club of claim 1 wherein said selected plane is perpendicular to a plane defined by said face of said clubhead.

5. An improved golf club comprising:

a clubhead having a face, a top, a back, a toe, a heel, and a sole, said sole having a leading edge proximate said face;

an elongated shaft having a longitudinal axis, a forwardly facing surface and a lower end; and a hosel for connecting said clubhead to said lower end of said elongated shaft, said hosel having an upper end attached to said lower end of said elongated shaft, a lower end and a curved middle member;

wherein said upper end of said hosel is axially aligned with said lower end of said elongated shaft;

wherein said lower end of said hosel is attached to said clubhead; and said curved middle member of said hosel defining a compound curve having a first curved portion disposed entirely in a selected plane, said selected plane intersecting said longitudinal axis of said elongated shaft, said curved middle member of said hosel having a second curved portion disposed entirely in said selected plane, said first and second curved portions and said longitudinal axis of said elongated shaft being entirely coplanar, wherein said selected plane is perpendicular to a plane defined by said face of said clubhead and further wherein said first and second curved portions are adapted to allow said elongated shaft and said hosel to pass over a top of said clubhead face between said toe and said heel such that said leading edge of said sole is aligned with said forwardly facing surface of said shaft, and such that said lower end of said hosel is attached to said top approximately 0.625 inches from said heel.

6. An improved golf club comprising:

a clubhead having a face, a top, a back, a toe, a heel, and a sole, said sole having a leading edge proximate said face, said back having an upper edge;

an elongated shaft having a longitudinal axis, a forwardly facing surface and a lower end; and a hosel for connecting said clubhead to said lower end of said elongated shaft, said hosel having an upper end, a lower end and an angled middle member, said upper end being attached to said lower end of said elongated shaft;

wherein said upper end of said hosel is axially aligned with said lower end of said elongated shaft;

wherein said lower end of said hosel is attached to said clubhead; and wherein said upper end of said hosel, said lower end of said hosel, said angled middle member and said longitudinal axis of said shaft are entirely coplanar, said angled middle member of said hosel being adapted to allow said elongated shaft and said hosel to pass over a top of said clubhead face and said top of said club head such that said leading edge of said sole is aligned with said forwardly facing surface of said shaft, and such that said lower end of said hosel is attached to said top of said clubhead approximately 0.625 inches from said heel.

* * * * *